US005169109A

United States Patent [19]

Sheppard

[11] Patent Number: 5,169,109

[45] Date of Patent: Dec. 8, 1992

[54] BOTTLE HANGER ADAPTER

[76] Inventor: John H. Sheppard, 2960 Dacusville Hwy., Easley, S.C. 29640

[21] Appl. No.: 795,196

[22] Filed: Nov. 19, 1991

[51] Int. Cl.[5] ..... A47K 1/08

[52] U.S. Cl. ..... 248/312; 248/205.5

[58] Field of Search ..... 248/312, 314, 315, 205.5, 248/312.1

[56] References Cited

U.S. PATENT DOCUMENTS

| | | | |
|---|---|---|---|
| 769,846 | 9/1904 | Stocker | 248/312 |
| 1,206,660 | 11/1916 | Boisseau | 248/312 |
| 1,730,753 | 10/1929 | Belt | 248/205.5 |
| 1,751,463 | 3/1930 | Backus et al. | 248/205.5 X |
| 1,868,023 | 7/1932 | North | 248/205.5 X |
| 3,062,490 | 11/1962 | Morgan | 248/312 |
| 3,653,624 | 4/1972 | Abel | 248/312 |
| 3,945,060 | 3/1976 | Gargione | 248/312 X |
| 4,280,638 | 7/1981 | Keihm | 248/312 X |
| 4,955,572 | 9/1990 | Simmons | 248/312 |

*Primary Examiner*—Carl D. Friedman
*Assistant Examiner*—Korie H. Chan
*Attorney, Agent, or Firm*—Bailey & Hardaway

[57] ABSTRACT

A bottle hanger adapter having a collar defining an aperture and an outer circumferential rim for engaging a lip carried by a suction disc where the lip engages the collar and the collar rim thereby providing a means of supporting bottles carrying the collar.

1 Claim, 2 Drawing Sheets

BOTTLE HANGER ADAPTER

BACKGROUND OF THE INVENTION

The present invention relates to the art of securing bottles of shampoo and other similar products within easy reach of the user.

DESCRIPTION OF THE PRIOR ART

Many commercial products are available for holding shampoo and similar shaped tub and shower products in a convenient position for the user. Whether due to age or injury, many people are unable to safely bend over in a shower in order to reach bath products which commonly reside on a tub ledge. As a result, bottle racks which fit over a shower head, as well as shelving systems held in place by tension rods, have been widely used in the art to place cleaning products in easy reach of someone in shower. However, shower head racks tend to interfere with the adjustment of the shower head and are often inadvertently hit jarring the contents loose. Shelving units tend to collect moisture resulting in mildew problems. Further, both shelves and racks interfere with the cleaning of the tub/shower facility.

Thus, there is a need for an apparatus which permits the positioning of shampoo and other similar containers in a location convenient to the user but which does not interfere with the normal use of the shower and which does not create cleaning obstacles.

SUMMARY OF THE INVENTION

It is thus an object of this invention to provide a bottle hanger apparatus which can secure a bottle to a walled surface of a shower or tub.

It is a further object of this invention to provide a bottle hanger apparatus which does not interfere with the normal use or cleaning of the shower environment.

It is still a further and more particular object of this invention to provide a bottle hanger apparatus which can reversibly engage to a variety of walled surfaces.

It is still a further and more particular object of this invention to provide a bottle hanger apparatus which does not damage or mar the attachment walls.

These and other objects of the invention are provided by a bottle hanger apparatus which provides a collar which is inserted over the neck of the bottle and secured in place by the reattachment of the bottle's screw on cap. The collar has an upper surface, a lower surface and an outer rim which projects below the plane of the lower surface. An aperture traverses the center of the collar to allow placement of the collar over a bottle's neck. A separate suction mounted lip is reversibly attached to a shower wall, the lip then being used to engage the lower surface and rim of the collar thereby supporting the attached bottle.

DETAILED DESCRIPTION

According to this invention, a novel bottle hanger is provided which can secure bottles of shampoo and similarly packaged goods to the typically hard surfaced tub/shower walled surfaces.

Figure 1:
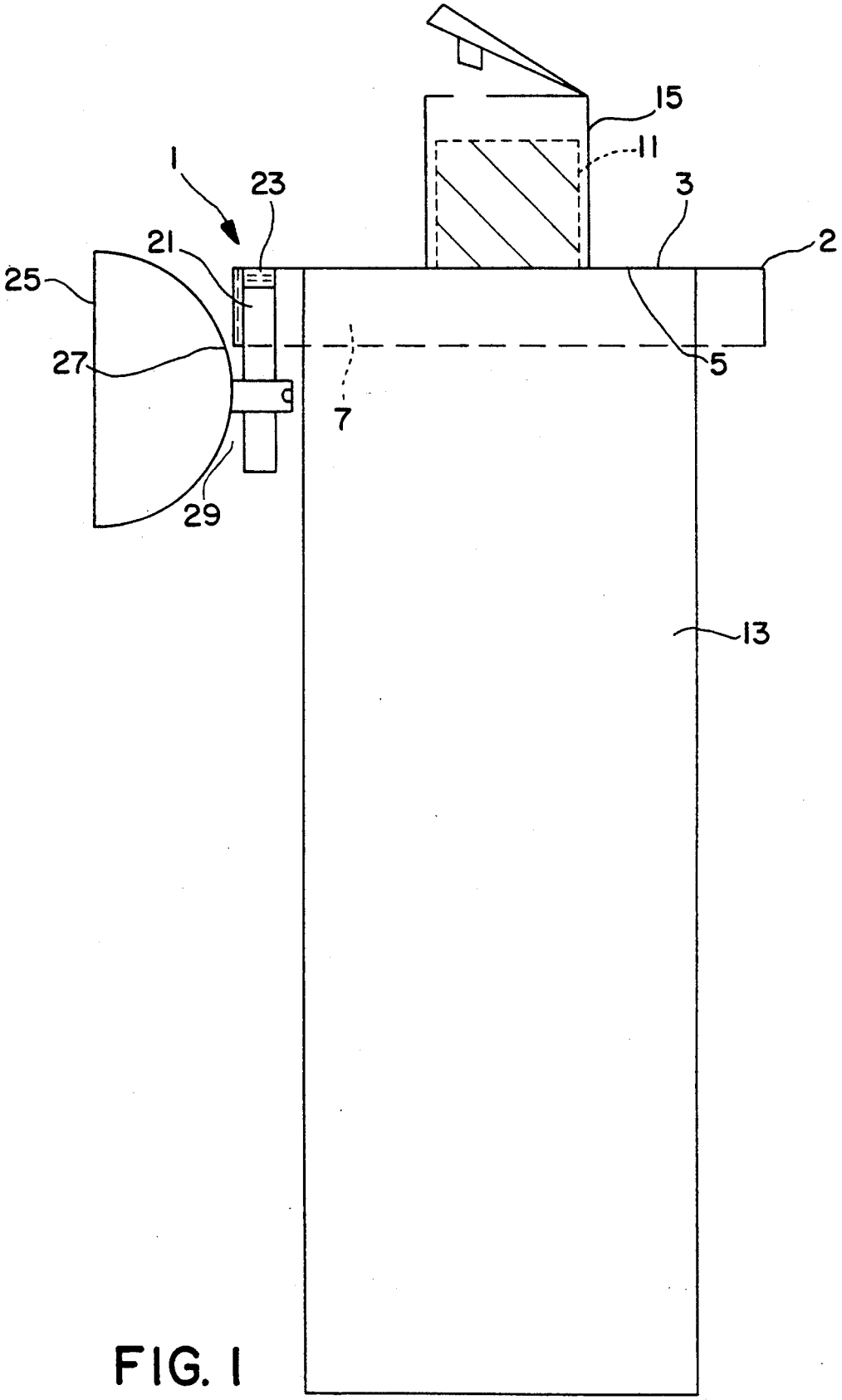
FIG. 1 is a perspective view in partial section of the bottle hanger adapter seen in partial section.
Figure 2:
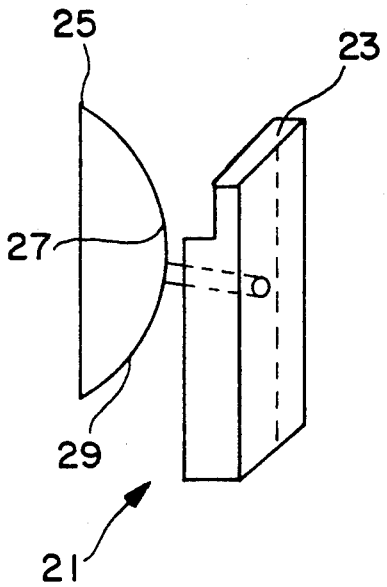
FIG. 2 is a perspective view of the wall mounted lip.
Figure 3:
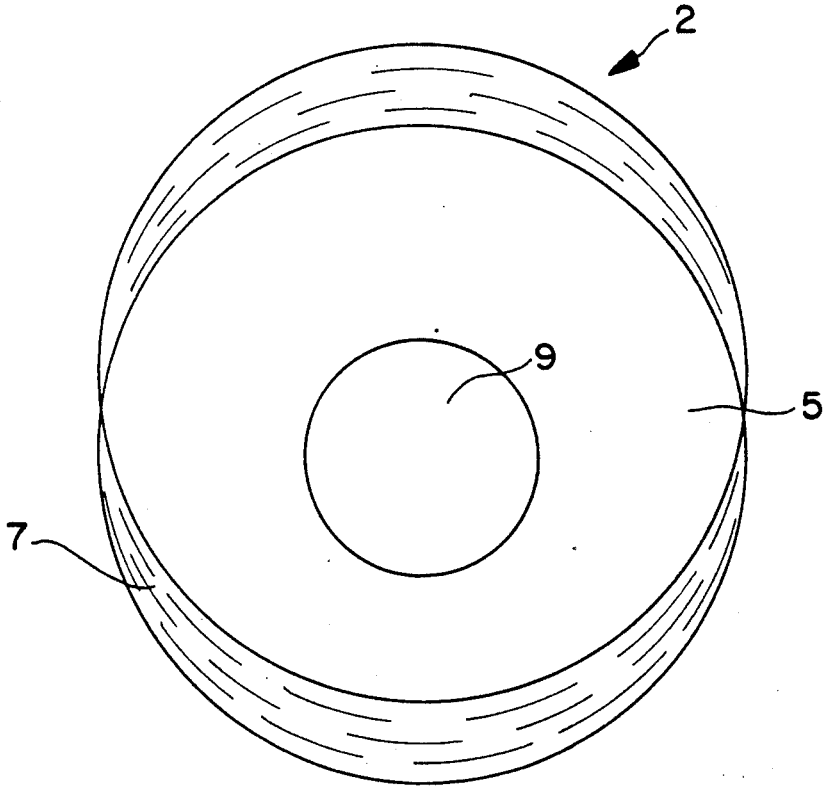
FIG. 3 is a perspective view of the bottle hanger collar.

In reference to FIGS. 1 through 3, a bottle hanger apparatus 1 has a collar 2 and a wall mounted lip 21. Collar 2 has an upper surface 3, a lower surface 5 and a rim 7 which extends below the plain of lower surface 5. A circular aperture 9 traverses surfaces 3 and 5. Aperture 9 should be slightly larger than the neck 11 of bottle 13 so that collar 2 may be inserted over neck 11. A cap 15 has been reattached to bottle 13 securing collar 2 between bottle 13 and cap 15.

The bottle with attached collar can then engage the upper edge 23 of lip 21. Lip 21 is carried by the convex side 27 of a suction disk 25, the disk being used to reversibly anchor lip 21 to a wall or other support. Concave side 29 of disk 25 can reversibly engage common bathroom wall material such as tile, marble, fiberglass, acrylic, as well as sliding glass bathroom doors. All such surfaces provide an optimal surface for mounting suction disk 25.

Edge 23 is designed to engage the lower surface 5 of collar 2. Rim 7 prevents lip 21 from disengaging from the collar. As seen in the embodiment of FIG. 2, lip 21 has an arcuate surface which corresponds to the arcuate rim 7.

The present invention allows bottles of shampoo to be placed at any height or location within a shower or tub. This is a particular usefulness for individuals with limited mobility who may not be physically able to reach bottles stored on a tub ledge or on an elevated rack. Further, the present invention allows the user to sequentially organize bathroom products. This is advantageous of individuals with poor eyesight who, through the use of the invention, can now organize products by location.

The bottle hanger apparatus is preferably constructed of a rigid plastic, nylon or rubber material which is resistant to impacts and impervious to high moisture and temperature variations. Further, the apparatus is compact and portable making it suitable for traveling.

It is thus seen in accordance with this invention, an apparatus is provided which allows bottles of personal cleaning products to be reversibly attached to a shower wall. This arrangement allows the efficient positioning of bathroom supplies at a safe location and in a manner which does not damage walls or interfere with the cleaning of the shower. As variations will become apparent to those of skill in the art from a reading of the above description, such variations are embodied within the spirit and scope of the invention as defined by the following appended claims.

I claim:

1. A bottle hanger adapter for securing a bottle to a surface comprising:

a bottle having a neck thereon;

a cap for attachment to said neck;

a collar having an upper surface, a lower surface and an outer circumferential rim, said rim extending below a plane of said lower surface;

said collar defining an aperture, said aperture in communication with said upper and said lower collar surfaces;

a suction disk;

a mounting lip attached to said suction disk;

said collar aperture being mounted over said neck of said bottle, said collar being secured to said bottle by said cap, the rim and lower surface of said collar being positioned upon said lip at any point around the circumference thereof and said suction disk attached to a surface, said lip thereby supporting said bottle against said surface.

* * * * *